US011434577B2

(12) United States Patent
Rodriguez et al.

(10) Patent No.: US 11,434,577 B2
(45) Date of Patent: Sep. 6, 2022

(54) ACID AQUEOUS BINARY SILVER-BISMUTH ALLOY ELECTROPLATING COMPOSITIONS AND METHODS

(71) Applicant: Rohm and Haas Electronic Materials LLC, Marlborough, MA (US)

(72) Inventors: Miguel A. Rodriguez, Roxbury, MA (US); Youngmin Yoon, Boston, MA (US); Michael Lipschutz, Natick, MA (US); Jamie Y. C. Chen, Worcester, MA (US)

(73) Assignee: ROHM AND HAAS ELECTRONIC MATERIALS LLC, Marlborough, MA (US)

( * ) Notice: Subject to any disclaimer, the term of this patent is extended or adjusted under 35 U.S.C. 154(b) by 0 days.

(21) Appl. No.: 17/008,691

(22) Filed: Sep. 1, 2020

(65) Prior Publication Data

US 2021/0115582 A1 Apr. 22, 2021

Related U.S. Application Data

(66) Substitute for application No. 62/916,456, filed on Oct. 17, 2019.

(51) Int. Cl.
*C25D 3/64* (2006.01)
*C25D 21/12* (2006.01)

(52) U.S. Cl.
CPC ..... *C25D 3/64* (2013.01); *C25D 21/12* (2013.01)

(58) Field of Classification Search
None
See application file for complete search history.

(56) References Cited

U.S. PATENT DOCUMENTS 7,628,903 B1 * 12/2009 Tsuji ..... C25D 3/64 106/1.23

* cited by examiner

*Primary Examiner* — Wojciech Haske
(74) *Attorney, Agent, or Firm* — John J. Piskorski

(57) ABSTRACT

Aqueous acid binary silver-bismuth alloy electroplating compositions and methods enable electroplating silver rich binary silver-bismuth deposits. The aqueous acid binary silver-bismuth alloy electroplating compositions include thiol terminal aliphatic compounds having carboxyl or sulfonic groups which enable deposition of silver rich binary silver-bismuth alloys having deposits which are matte to semi-bright, uniform and have a low coefficient of friction.

10 Claims, 3 Drawing Sheets

ACID AQUEOUS BINARY SILVER-BISMUTH ALLOY ELECTROPLATING COMPOSITIONS AND METHODS

FIELD OF THE INVENTION

The present invention is directed to acidic aqueous binary silver-bismuth alloy electroplating compositions and methods. More specifically, the present invention is directed to acidic aqueous binary silver-bismuth alloy electroplating compositions and methods, wherein the acidic aqueous binary silver-bismuth alloy electroplating compositions include thiol terminal aliphatic compounds having carboxyl or sulfonic groups which enable electrodeposition of silver rich binary silver-bismuth alloys having good electrical conductivity, low electrical contact resistance and a low coefficient of friction.

BACKGROUND OF THE INVENTION

Silver and silver alloy plating baths are highly desirable for depositing silver and silver alloys on substrates in applications directed to the manufacture of electronic components and jewelry. Substantially pure silver is used as a contact finish because of its excellent electrical properties. It has high conductivity and low electrical contact resistance. However, its use as a contact finish for, example, electrical connectors are limited because of their poor resistance to mechanical wear and high silver-on-silver coefficient of friction. The poor resistance to mechanical wear results in the connector becoming physically damaged after a relatively low number of insertion-deinsertion cycles of the connector. A high coefficient of friction contributes to this wear problem. When connectors have a high coefficient of friction, the force required to insert and deinsert the connector is very high and this can damage the connector or limit the connector design options. Silver alloy deposits, such as silver-antimony and silver-tin, result in improved wear properties but have unacceptably poor contact resistance, especially after thermal aging. Maintaining good contact resistance upon exposure to high heat over time is important as silver alloys are commonly used in components for automobile engines, and for electrical connectors which are exposed to high soldering temperatures.

Since many silver salts are substantially water-insoluble and silver salts which are water-soluble often form insoluble salts with various compounds commonly present in plating baths, the plating industry is faced with numerous challenges to formulate a silver or silver alloy plating bath which is stable long enough for practical plating applications and addresses at least the foregoing problems. Many silver and silver-tin alloy plating baths include cyanide compounds to enable practical applications. However, cyanide compounds are extremely poisonous. Therefore, special waste water treatment is required. This results in a rise in treatment costs. Further, since these baths can only be used in the alkaline range, the types of alloying metals are limited. Many metals are not soluble under alkaline conditions and precipitate out of solution, such as metal hydroxides. Another disadvantage of alkaline baths is their incompatibility with many photoresist materials which are used to mask off areas on a substrate where plating is to be avoided. Such photoresists can dissolve under alkaline conditions.

Alkaline baths can also passivate substrates such that poor adhesion results between the plated metal and the substrate. This is often addressed by an extra step called "strike" plating which increases the number of processing steps, thus reducing the overall efficiency of the metal plating process.

Therefore, there is a need for a silver alloy plating bath which is stable, acidic, and produces a silver alloy which has high conductivity, low electrical contact resistance and low coefficient of friction.

SUMMARY OF THE INVENTION

The present invention is directed to binary silver-bismuth alloy electroplating compositions comprising a source of silver ions, a source of bismuth ions, and a thiol terminal aliphatic compound having a general formula:

$$HS\text{-}A\text{-}R^1 \quad (I)$$

wherein A is a substituted or unsubstituted $(C_1\text{-}C_4)$alkanediyl and $R^1$ is a carboxyl group, carboxylate group, sulfonic group or sulfonate group, and a pH of less than 7, wherein a substituent group is selected from the group consisting of $(C_1\text{-}C_3)$alkyl, carboxy$(C_1\text{-}C_3)$alkyl and $—NH_2$.

The present invention is also directed to a method of electroplating binary silver-bismuth alloys on a substrate including:

a) providing the substrate;

b) contacting the substrate with a binary silver-bismuth alloy electroplating composition comprising a source of silver ions, a source of bismuth ions, and a thiol terminal aliphatic compound having a general formula:

$$HS\text{-}A\text{-}R^1 \quad (I)$$

wherein A is substituted or unsubstituted $(C_1\text{-}C_4)$alkanediyl and $R^1$ is a carboxyl group carboxylate group, sulfonic group or sulfonate group, and a pH of less than 7, wherein a substituent group is selected from the group consisting of $(C_1\text{-}C_3)$alkyl, carboxy$(C_1\text{-}C_3)$alkyl and $—NH_2$; and c) applying an electric current to the binary silver-bismuth alloy electroplating composition and the substrate to electroplate a silver-bismuth alloy deposit on the substrate.

The present invention is further directed to an article comprising a binary silver-bismuth alloy layer adjacent a surface of a substrate, wherein the binary silver-bismuth alloy layer comprises 90% to 99% silver and 1% to 10% bismuth and has a coefficient of friction of 1 or less.

Including thiol terminal aliphatic compounds having formula (I) above in aqueous binary silver-bismuth electroplating compositions in an acidic environment enables deposition of silver rich binary silver-bismuth alloys on a substrate such that the silver rich binary silver-bismuth alloys have substantially the good electrical properties of a silver deposit, such as good electrical conductivity and low electrical contact resistance, and comparable to gold. In addition, the silver rich binary silver-bismuth alloy deposits have a low coefficient of friction such that the silver rich binary silver-bismuth alloy deposits have good mechanical wear resistance. The silver rich binary silver-bismuth deposits are uniform and bright in appearance. The binary silver-bismuth alloy electroplating compositions of the present invention are stable.

DETAILED DESCRIPTION OF THE INVENTION

Figure 1:
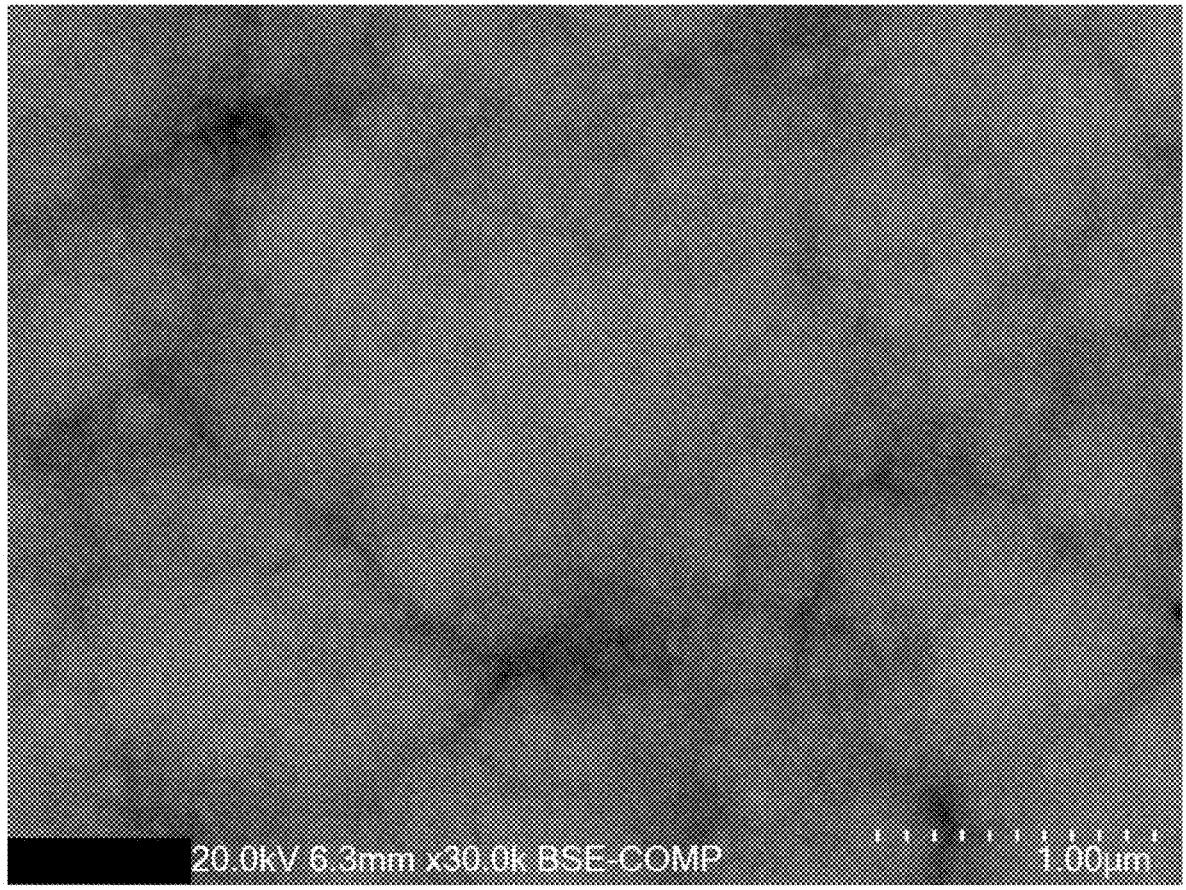
FIG. 1 is an SEM at 30,000× of the binary silver-bismuth alloy showing finely dispersed bismuth in a silver matrix

As used throughout the specification the abbreviations have the following meanings, unless the context clearly indicates otherwise: ° C.=degrees Centigrade; ppm=parts per million; one ppm=one mg/L; g=gram; mg=milligram; L=liter; mL=milliliter; mm=millimeters; cm=centimeter; μm=microns; DI=deionized; A=amperes; ASD=amperes/$dm^2$=plating speed; DC=direct current; v=volts, which is the SI unit of electromotive force; mΩ=milliohms=electrical resistance; cN=centiNewtons=a unit of force; N=newtons; COF=coefficient of friction; rpm=revolutions per minute; s=seconds; SEM=scanning electron micrograph; 2D=two-dimensional; 3D=three-dimensional; Ag=silver; Bi=bismuth; Au=gold; and Cu=copper.

The term "alkanediyl (plural=alkanediyls)" means any of a series of divalent radicals of the general formula $C_nH_{2n}$ derived from aliphatic hydrocarbons, unless specified otherwise, such alkanediyls include substituted alkanediyls. The term "alkylene" is an obsolete term or synonym for "alkanediyl". The term "aliphatic" means relating to or denoting organic compounds in which carbon atoms form open chains (as in alkanes), not aromatic rings. The term "binary" in reference of an alloy means a metallic solid composed of a homogenous mixture of two metals. The term "adjacent" means directly in contact with such that two metal layers have a common interface. The term "contact resistance" means electrical resistance arising from the contact between two electrically conductive articles measured as a function of applied force between those two articles. The term "reduction potential" means a measure of the tendency of metal ions to acquire electrons and thereby be reduced to metal. The abbreviation "N" means Newtons which is the SI unit of force and it is equal to the force that would give a mass of one kilogram an acceleration of one meter per second per second, and is equivalent to 100,000 dynes. The term "coefficient of friction" is a value that shows the relationship between the force of friction between two objects and the normal reaction between the objects that are involved; and is shown by $F_f=\mu F_n$, wherein $F_f$ is the frictional force, μ is the coefficient of friction and $F_n$ is the normal force, wherein normal force is the force applied between two articles which is perpendicular to the direction of relative motion between the two articles while measuring the frictional force between them. The term "tribology" means the science and engineering of interacting surfaces in relative motion and includes the study and application of the principles of lubrication, friction and wear. The term "wear resistance" means loss of material from a surface by means of mechanical action. The term "aqueous" means water or water-based. The terms "composition" and "bath" are used interchangeably throughout the specification. The terms "deposit" and "layer" are used interchangeably throughout the specification. The terms "electroplating", "plating" and "depositing" are used interchangeably throughout the specification. The term "matte" means dull or without luster. The terms "a" and "an" can refer to both the singular and the plural throughout the specification. All percent (%) values and ranges indicate weight percent unless otherwise specified. All numerical ranges are inclusive and combinable in any order, except where it is logical that such numerical ranges are constrained to add up to 100%.

The present invention is directed to an aqueous acidic binary silver-bismuth electroplating composition, wherein the aqueous acidic binary silver-bismuth electroplating composition includes a source of silver ions, a source of bismuth ions and a thiol terminal aliphatic compound having a general formula:

$$HS\text{-}A\text{-}R^1 \quad (I)$$

wherein A is a substituted or unsubstituted $(C_1\text{-}C_4)$alkanediyl and $R^1$ is a carboxyl group, carboxylate group and counter cation, sulfonic group or sulfonate group and counter cation, and a pH of less than 7, wherein a substituent group is selected from the group consisting of $(C_1\text{-}C_3)$alkyl, carboxy$(C_1\text{-}C_3)$alkyl and —$NH_2$.

Such compounds having formula (I) above are complexing agents selective for bismuth ions. Preferably, the aqueous acid binary silver-bismuth alloy electroplating composition of the present invention include a molar ratio of the thiol terminal aliphatic compounds of formula (I) to bismuth ions of at least 3:1, more preferably, from 3:1 to 10:1, even more preferably, from 3:1 to 6:1, most preferably from 3.5:1 to 4.5:1.

The matte to semi-bright and uniform silver rich binary silver-bismuth alloy deposits have substantially good electrical properties, such as good electrical conductivity and low electrical contact resistance. The silver rich binary silver-bismuth alloy deposit has a low coefficient of friction such that the silver rich binary silver-bismuth alloy layers have good mechanical wear resistance. The acidic aqueous binary silver-bismuth alloy electroplating compositions of the present invention are stable. The aqueous binary silver-bismuth alloy electroplating compositions are free of any additional alloying metals, such as, but not limited to, antimony, tin, copper, nickel, cobalt, cadmium, gold, lead, indium, iron, palladium, platinum, rhodium, ruthenium, tellurium, thallium, selenium and zinc. Preferably, the acidic aqueous silver-bismuth electroplating compositions are cyanide-free.

Preferably, the thiol terminal aliphatic compounds of the present invention are chosen from one or more of:

(II)

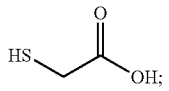

thioglycolic acid (III)

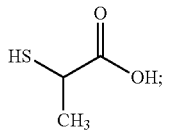

2-mercaptopropionic acid

-continued (IV)

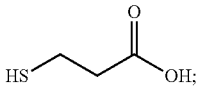

3-mercaptopropionic acid (V)

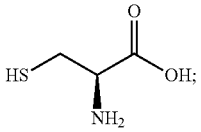

cysteine (VI)

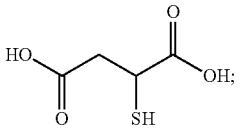

mercaptosuccinic acid (V)

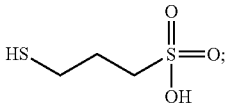

3-mercapto-1-propanesulfonic acid (VI)

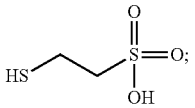

2-mercaptoethanesulfonic acid salts of the thiol terminal aliphatic compounds. More preferably, the thiol terminal aliphatic compounds of the present invention are chosen from one or more of 2-mercaptopropionic acid, 3-mercaptopropionic acid, cysteine, mercaptosuccinic acid, 3-mercapto-1-propanesulfonic acid, 2-mercaptoethanesulfonic acid, and salts of the thiol terminal aliphatic compounds; even more preferably, the thiol terminal aliphatic compounds of the present invention are chosen from one or more of cysteine, mercaptosuccinic acid, 3-mercapto-1-propanesulfonic acid, 2-mercaptoethanesulfonic acid, and salts of the thiol terminal aliphatic compounds; further preferably, the thiol aliphatic compounds of the present invention are chosen from one or more of mercaptosuccinic acid, 3-mercapto-1-propanesulfonic acid, 2-mercaptoethanesulfonic acid, and salts of the thiol terminal aliphatic compounds; and most preferably, the thiol terminal aliphatic compounds of the present invention are chosen from one or more of 3-mercapto-1-propanesulfonic acid, 2-mercaptoethanesulfonic acid, and salts of the thiol terminal aliphatic compounds. Salts of the thiol compounds of the present invention include, but are not limited to, alkali metal salts such as sodium, potassium, lithium and cesium salts, ammonium salts and tetraalkylammonium salts.

Examples of preferred salts are ammonium thioglycolate; sodium thioglycolate; mercaptosuccinate, sodium salt; 3-mercapto-1-propanesulfonate, sodium salt; 3-mercapto-1-ethanesulfonate, sodium salt and 3-mercapto-1-ethanesulfonate, potassium salt. Mixtures of such preferred salts can also be included in the binary silver-bismuth electroplating compositions of the present invention. More preferably, the salts are mercaptosuccinate, sodium salt; 3-mercapto-1-propanesulfonate, sodium salt and 3-mercapto-1-ethanesulfonate, sodium salt.

The thiol terminal aliphatic compounds of the present invention are included in sufficient amounts to enable electroplating of a silver rich binary silver-bismuth alloy in an aqueous acid environment. Preferably, the thiol terminal aliphatic compounds of the present invention are included in amounts of 5 g/L or greater, more preferably, the thiol compounds are included in amounts of 10 g/L to 100 g/L, further preferably, from 15 g/L to 60 g/L, even more preferably, from 20 g/L to 50 g/L, most preferably, from 30 g/L to 50 g/L.

The aqueous acid silver-bismuth alloy electroplating compositions of the present invention include a source of silver ions. Sources of silver ions can be provided by silver salts such as, but not limited to, silver halides, silver gluconate, silver citrate, silver lactate, silver nitrate, silver sulfates, silver alkane sulfonates, silver alkanol sulfonates or mixtures thereof. When a silver halide is used, preferably the halide is chloride. Preferably, the silver salts are silver sulfate, a silver alkane sulfonate, silver nitrate, or mixtures thereof, more preferably, the silver salt is silver sulfate, silver methanesulfonate, or mixtures thereof. Mixtures of silver salts can also be included in the compositions. The silver salts are generally commercially available or can be prepared by methods described in the literature. Preferably, the silver salts are readily water-soluble.

The amount of silver salts included in the aqueous acid binary silver-bismuth electroplating compositions are in amounts sufficient to provide a desired matte to semi-bright and uniform silver rich binary silver-bismuth alloy deposit, preferably, where the silver content of the silver rich binary silver-bismuth alloy deposit contains 90% to 99.8% silver, further preferably, from 90% to 99.7% silver, more preferably, from 93% to 99.7% silver, most preferably, from 95% to 99% silver. Preferably, silver salts are included in the compositions to provide silver ions at a concentration of at least 10 g/L, more preferably, silver salts are included in the compositions in amounts to provide silver ion concentrations in amounts of 10 g/L to 100 g/L, further preferably, silver salts are included in amounts to provide silver ion concentrations of 20 g/L to 80 g/L, even more preferably, silver salts are included in amounts to provide silver ions at concentrations of 20 g/L to 70 g/L, most preferably, silver salts are included in the compositions in amounts to provide silver ion concentrations of 20 g/L to 60 g/L.

The aqueous acid silver-bismuth alloy electroplating compositions include a source of bismuth ions which provide the electroplating bath with $Bi^{3+}$ ions in solution. Sources of bismuth ions include, but are not limited to, bismuth salts of alkane sulfonic acids such as bismuth methanesulfonate, bismuth ethanesulfonate, bismuth propanesulfonate, 2-bismuth propane sulfonate and bismuth p-phenolsulfonate, bismuth salts of alkanolsulfonic acids such as bismuth hydroxymethanesulfonate, bismuth 2-hydoxyethane-1-sulfonate and bismuth 2-hydroxybutane-1-sulfonate, and bismuth salts such as bismuth nitrate, bismuth sulfate, bismuth chloride and bismuth oxides. Mixtures of bismuth salts can also be included in the compositions. Preferably, the bismuth salts are water soluble.

The amount of bismuth salts included in the aqueous acid binary silver-bismuth electroplating compositions are in amounts sufficient to provide a desired matte to semi-bright and uniform silver rich binary silver-bismuth alloy deposit, preferably, where the bismuth content of the silver rich binary silver-bismuth alloy deposit contains 0.2% to 10% bismuth, further preferably, from 0.3% to 10% bismuth, more preferably, from 0.3% to 7% bismuth, most preferably, from 1% to 5% bismuth. Preferably, bismuth salts are included in the silver-bismuth compositions to provide bismuth (III) ions in amounts of 50 ppm to 10 g/L, further preferably, from 100 ppm to 5 g/L, more preferably, from 200 ppm to 1 g/L, most preferably, from 300 ppm to 800 ppm. Such bismuth salts are commercially available or can be made according to disclosures in the chemical literature. They are generally commercially available from a variety of sources, such as Aldrich Chemical Company, Milwaukee, Wis.

Preferably, in the aqueous acid silver-bismuth alloy electroplating compositions of the present invention, the water included as a solvent is at least one of deionized and distilled to limit incidental impurities.

Optionally, an acid can be included in the binary silver-bismuth alloy electroplating compositions to assist in providing conductivity to the compositions. Acids include, but are not limited to, organic acids such as acetic acid, citric acid, arylsulfonic acids, alkanesulfonic acids, such as methanesulfonic acid, ethanesulfonic acid and propanesulfonic acid, aryl sulfonic acids such as phenylsulfonic acid and tolylsulfonic acid, and inorganic acids such as sulfuric acid, sulfamic acid, hydrochloric acid, hydrobromic acid and fluoroboric acid. Water-soluble salts of the foregoing acids also can be included in the binary silver-bismuth alloy electroplating compositions of the present invention. Preferably, the acids are acetic acid, citric acid, alkane sulfonic acids, aryl sulfonic acids, or salts thereof, more preferably the acids are acetic acid, citric acid, methanesulfonic acid, or salts thereof. Such salts include, but are not limited to, alkali metal salts such as sodium, potassium, lithium, and cesium salts, ammonium, tetraalkylammonium salts and magnesium salts. Such salts also include, but are not limited to, sodium and potassium acetate trisodium citrate, sodium citrate dibasic, sodium citrate monobasic, trisodium citrate, tripotassium citrate, dipotassium citrate, dipotassium citrate dibasic and potassium citrate monobasic. Although a mixture of acids can be used, preferably, when used, a single acid is used. The acids are generally commercially available or can be prepared by methods known in the literature. Such acids can be included in amounts to provide a desired conductivity. Preferably, the acids or salts thereof are included in amounts of at least 5 g/L, more preferably, from 10 g/L to 250 g/L, even more preferably, from 30 g/L to 150 g/L, most preferably from 30 g/1 to 125 g/L.

The pH of the aqueous acidic binary silver-bismuth alloy electroplating composition is less than 7. Preferably, the pH is 0 to 6, more preferably, the pH is from 0 to 5, further preferably, the pH is from 0 to 3, even more preferably, the pH is from 0 to 2.5, most preferably, the pH is from 0 to 2.

Optionally, a pH adjusting agent can be included in the aqueous acid binary silver-bismuth alloy compositions of the present invention. Such pH adjusting agents include inorganic acids, organic acids, inorganic bases or organic bases and salts thereof. Such acids include, but are not limited to, inorganic acids such as sulfuric acid, hydrochloric acid, sulfamic acid, boric acid, phosphoric acid and salts thereof. Organic acids include, but are not limited to, acetic acid, citric acid, amino acetic acid and ascorbic acid and salts thereof. Such salts include, but are not limited to, trisodium citrate. Inorganic bases such as sodium hydroxide and potassium hydroxide and organic bases such as various types of amines can be used. Preferably, the pH adjusting agents are chosen from acetic acid, citric acid and amino acetic acid and salts thereof, most preferably, acetic acid, citric acid and salts thereof. The pH adjusting agents can be added in amounts as needed to maintain a desired pH range.

Optionally, but preferably, a dihydroxy bis-sulfide compound or mixtures thereof can be included in the aqueous acid silver-bismuth alloy electroplating compositions of the present invention. Such dihydroxy bis-sulfide compounds include, but are not limited to, 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-dodecanediol, 3,13-dithia-1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,11-undecanediol, 5,9-dithia-1,13-tridecanediol, 5,13-dithia-1,17-heptadecanediol, 5,17-dithia-1,21-uneicosanediol and 1,8-dimethyl-3,6-dithia-1,8-octanediol. Preferably, the dihydroxy bis-sulfide compounds are chosen from 3,6-dithia-1,8-octanediol, 3,8-dithia-1,10-decanediol, 2,4-dithia-1,5-pentanediol, 2,5-dithia-1,6-hexanediol, 2,6-dithia-1,7-heptanediol, 2,7-dithia-1,8-octanediol, more preferably, 3,6-dithia-1,8-octanediol, 2,4-dithia-1,5-pentanediol, 2,5-dithia-1,6-hexanediol, 2,6-dithia-1,7-heptanediol, and 2,7-dithia-1,8-octanediol, even more preferably, 3,6-dithia-1,8-octanediol, 2,6-dithia-1,7-heptanediol, and 2,7-dithia-1,8-octanediol, most preferably, 3,6-dithia-1,8-octanediol.

Preferably, dihydroxy bis-sulfide compounds can be included in the aqueous acid binary silver-bismuth alloy electroplating compositions in amounts of at least 0.5 g/L, more preferably, from 10 g/L to 200 g/L, even more preferably, from 50 g/L to 150 g/L, further preferably, from 50 g/L to 125 g/L, and most preferably, from 80 g/L to 115 g/L.

Optionally, one or more surfactants can be included in the aqueous acid silver-nickel alloy electroplating compositions of the present invention. Such surfactants include, but are not limited to, ionic surfactants such as cationic and anionic surfactants, non-ionic surfactants and amphoteric surfactants. Surfactants can be included in conventional amounts such as 0.05 gm/L to 30 gm/L.

Examples of anionic surfactants are sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate. Examples of cationic surfactants are quaternary ammonium salts such as perfluorinated quaternary amines.

Other optional additives can include, but are not limited to, brighteners and biocides. Conventional brighteners and biocides well known in the art can be included in the aqueous acid binary silver-bismuth electroplating compositions. Such optional additives can be included in conventional amounts.

Preferably, the acidic aqueous binary silver-bismuth alloy electroplating compositions of the present invention are composed of water, silver ions and counter anions, bismuth (III) ions and counter anions, a thiol terminal aliphatic compound having a general formula:

$$HS\text{-}A\text{-}R^1 \quad (I)$$

wherein A is a substituted or unsubstituted $(C_1-C_4)$alkanediyl and $R^1$ is a carboxyl group, carboxylate group, sulfonic group or sulfonate group, wherein a substituent group is selected from the group consisting of $(C_1-C_3)$alkyl, carboxy$(C_1-C_3)$alkyl and —$NH_2$, optionally a dihydroxy bis-sulfide compound, optionally an acid or salt thereof, optionally a pH adjusting agent, optionally a surfactant, optionally a brightener, and optionally a biocide, wherein a pH is less than 7.

Further preferably, the acidic aqueous binary silver-bismuth alloy electroplating compositions of the present invention are composed of water, silver ions and counter anions, bismuth (III) ions and counter anions, a thiol terminal aliphatic compound having a general formula:

$$HS\text{-}A\text{-}R^1 \quad (I)$$

wherein A is a substituted or unsubstituted $(C_1-C_4)$alkanediyl and $R^1$ is a carboxyl group, carboxylate group, sulfonic group or sulfonate group, wherein a substituent group is selected from the group consisting of $(C_1-C_3)$alkyl, carboxy$(C_1-C_3)$alkyl and —$NH_2$, a dihydroxy bis-sulfide compound, optionally an acid or salt thereof, optionally a pH adjusting agent, optionally a surfactant, optionally a brightener, and optionally a biocide, wherein a pH is 0-6.

More preferably, the acidic aqueous binary silver-bismuth alloy electroplating compositions of the present invention are composed of water, silver ions and counter anions, bismuth (III) ions and counter anions, a thiol terminal aliphatic compound having a general formula:

$$HS\text{-}A\text{-}R^1 \quad (I)$$

wherein A is a substituted or unsubstituted $(C_1-C_4)$alkanediyl and $R^1$ is a carboxyl group, carboxylate group, sulfonic group or sulfonate group, wherein a substituent group is selected from the group consisting of $(C_1-C_3)$alkyl, carboxy$(C_1-C_3)$alkyl and —$NH_2$, a dihydroxy bis-sulfide compound, an acid or salt thereof, optionally a pH adjusting agent, optionally a surfactant, optionally a brightener, and optionally a biocide, wherein a pH is 0-6.

Even more preferably, the acidic aqueous binary silver-bismuth alloy electroplating compositions of the present invention are composed of water, silver ions and counter anions, bismuth (III) ions and counter anions, a thiol terminal aliphatic compound selected from the group consisting of thioglycolic acid, 2-mercaptoproprionic acid, 3-mercaptopropionic acid, cysteine, mercaptosuccinic acid, 3-mercapto-1-propanesulfonic acid, 2-mercaptoethanesulfonic acid, salts of the thiol terminal aliphatic compounds, and mixtures thereof, a dihydroxy bis-sulfide compound, an acid or salt thereof, optionally a pH adjusting agent, optionally a surfactant, optionally a brightener, and optionally a biocide, wherein a pH is 0-3.

The acidic aqueous binary silver-bismuth alloy electroplating compositions of the present invention can be used to deposit binary silver-bismuth alloy layers on various substrates, both conductive and semiconductive substrates. Preferably, the substrates on which silver-bismuth alloy layers are deposited are copper and copper alloy substrates. Such copper alloy substrates include, but are not limited to, brass and bronze. The electroplating composition temperatures during plating can range from room temperature to 70° C., preferably, from 30° C. to 60° C., more preferably, from 40° C. to 60° C. The silver-bismuth alloy electroplating compositions are preferably under continuous agitation during electroplating.

The acidic aqueous binary silver-bismuth alloy electroplating method of the present invention includes providing a substrate, providing the acidic aqueous silver-bismuth alloy electroplating composition of the present invention and contacting the substrate with the acidic aqueous silver-bismuth alloy electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating binary silver-bismuth alloys to deposit adjacent a surface of a substrate.

The acidic aqueous silver-bismuth alloy electroplating compositions of the present invention enable deposition of matte to semi-bright and uniform silver rich silver-bismuth alloy layers over broad current density ranges. The silver rich silver-bismuth alloy includes 90% to 99.8% silver and 0.2% to 10% bismuth, preferably, 90% to 99.7% silver and 0.3% to 10% bismuth, more preferably, from 93% to 99.7% silver and from 0.3% to 7% bismuth, most preferably, 95% to 99% silver and from 1% to 5% bismuth, excluding unavoidable impurities in the alloy.

Current densities for electroplating the matte to semi-bright and uniform silver rich silver-bismuth alloy of the present invention can range from 0.1 ASD or higher. Preferably, the current densities range from 0.5 ASD to 70 ASD, further preferably, from 1 ASD to 40 ASD, more preferably, from 1 ASD to 30 ASD, even more preferably from 1 ASD to 15 ASD.

The thickness of the binary silver-bismuth alloy layers of the present invention can vary depending on the function of the silver-bismuth alloy layer and the type of substrate on which it is plated. Preferably, the silver-bismuth alloy layer ranges from 1 μm or greater. Further preferably, the silver-bismuth layers have thickness ranges of 1 μm to 100 μm, more preferably, from 1 μm to 50 μm, even more preferably, from 1 μm to 10 μm, most preferably from 1 μm to 5 μm.

While it is envisioned that the acidic aqueous binary silver-bismuth alloy electroplating compositions of the present invention can be used to plate various substrates which can include silver-bismuth alloy layers, preferably, the acidic aqueous silver-bismuth alloy electroplating compositions of the present invention are used to electroplate top layers or coatings on electrical connectors where substantial contact forces and wear are expected to prevail. The silver rich silver-bismuth alloy deposit is a highly desirable substitute for conventional silver coatings found on conventional connectors. The silver-bismuth alloy deposit has low electrical contact resistance. In addition, the silver-bismuth alloy deposit of the present invention has a low COF, preferably, a COF of 1 or less, more preferably, 0.3 or less. The COF of the silver-nickel alloy deposit of the present invention has a COF of, preferably, 40% or less than the COF of substantially pure silver deposits, more preferably, 80% or less, thus the binary silver-bismuth alloy of the present invention has substantial improvement in wear resistance over substantially pure silver. Surface wear can be determined for a metal deposit according to conventional tribological and profilometry measurements well known in the art.

The following examples are included to further illustrate the invention but are not intended to limit its scope.

Binary Silver-Bismuth Alloy Electroplating Examples 1-8

Unless otherwise noted, in all cases, the electroplating substrate was a 5 cm×5 cm brass (70% copper, 30% zinc)

coupon. Prior to electroplating, the coupons were electrocleaned in RONACLEAN™ GP-100 electrolytic alkaline degreaser (available from DuPont de Nemours) at room temperature for 30 seconds with DC at a current density of 5 ASD. After electrocleaning, the coupons were rinsed with DI water, activated in 10% sulfuric acid for 30 seconds, rinsed with DI water again, then placed in the electroplating bath. Electroplating was performed with DC at a current density of 1 ASD (actual current applied is 0.28 A) for 6 minutes to deposit a silver-bismuth deposit of about 4 μm. Electroplating was performed in a square, glass beaker using a platinized titanium anode. Agitation was provided by a 5 cm long, TEFLON-coated stir-bar at a rotation rate of 400 rpm. Electroplating was performed at a temperature of 55° C. All the silver-bismuth electroplating baths were aqueous based. Water was added to each bath to bring it to a desired volume. The pH of the electroplating baths was adjusted with potassium hydroxide or methane sulfonic acid.

The thickness and elemental composition of the electroplated silver-bismuth alloy was measured using a Bowman Series P X-Ray Fluorimeter (XRF) available from Bowman, Schaumburg, Ill. The XRF was calibrated using pure element thickness standards for silver and bismuth from Bowman and calculated alloy composition and thickness by combining the pure element standards with Fundamental Parameter (FP) calculations from the XRF instruction manual.

Example 1 (Invention)

An aqueous acid binary silver-bismuth electroplating bath of the following composition is prepared:

Silver methanesulfonate to supply 20 g/L silver ions
3,6-Dithia-1,8-octanediol: 102 g/L
Bismuth methanesulfonate to supply 2 g/L of bismuth ions
Cysteine: 9 g/L
3-mercapto-1-propanesulfonate, sodium salt: 2 g/L
pH adjusted to 2

After the plating procedure, the electrodeposited coating is metallic and matte, with a composition of 98% silver and 2% bismuth. FIG. 1 is an SEM at 30,000× of the binary silver-bismuth alloy showing finely dispersed bismuth in a silver matrix.

Example 2 (Invention)

An aqueous acid binary silver-bismuth alloy electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
Cysteine: 9 g/L
2-Mercaptoethane sulfonic acid: 400 ppm
pH adjusted to 2

After the plating procedure, the electrodeposited coating is metallic and semi-bright, with a composition of 95% silver and 5% bismuth.

Example 3 (Invention)

An aqueous acid binary silver-bismuth alloy electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
3-mercapto-1-propanesulfonate, sodium salt: 13.2 g/L
Cysteine: 400 ppm
pH adjusted to 2

After the plating procedure, the electrodeposited coating is metallic and semi-bright, with a composition of 96% silver and 4% bismuth.

Example 4 (Invention)

An aqueous acid binary silver-bismuth alloy electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
3-mercapto-1-ethanesulfonate, sodium salt: 12.2 g/L
Cysteine: 400 ppm
pH adjusted to 2

After the plating procedure, the electrodeposited coating is metallic and semi-bright, with a composition of 96% silver and 4% bismuth.

Example 5 (Invention)

An aqueous acid binary silver-bismuth alloy electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
Mercaptosuccinic acid: 11.1 g/L
3-mercapto-1-ethanesulfonate, sodium salt: 400 ppm
pH adjusted to 2

After the plating procedure, the electrodeposited coating is metallic and matte, with a composition of 98% silver and 2% bismuth.

Example 6 (Invention)

An aqueous acid binary silver-bismuth electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
Mercaptosuccinic acid: 11.9 g/L
2-mercaptopropionic acid: 400 ppm
pH adjusted to 2

After the plating procedure, the electrodeposited coating is metallic and matte, with a composition of 94% silver and 6% bismuth.

Example 7 (Invention)

An aqueous acid binary silver-bismuth electroplating bath of the following composition is prepared:

Silver methanesulfonate to supply 20 g/L silver ions
3,6-Dithia-1,8-octanediol: 102 g/L
Bismuth methanesulfonate to supply 5 g/L of bismuth ions
Mercaptoacetic acid: 9 g/L
2-mercaptoethanesulfonic acid: 400 ppm
pH adjusted to 2

After the plating procedure, the electrodeposited coating is metallic and semi-bright, with a composition of 95% silver and 5% bismuth.

Example 8 (Comparative)

An aqueous acid binary silver-bismuth electroplating bath of the following composition is prepared:

Silver methanesulfonate to supply 20 g/L silver ions

Bismuth methanesulfonate to supply 10 g/L of bismuth ions

Methanesulfonic acid: 150 g/L

Pluronic L-44 surfactant (purchased from BASF): 10 g/L

O-chlorobenzaldehyde: 100 ppm 3,6-Dithia-1,8-octanediol: 80 g/L pH<1

After the plating procedure, the electrodeposited coating is metallic and semi-bright, with a composition of 46% silver and 54% bismuth.

Example 9 (Invention)

Contact Resistance Measurements

Contact resistance was evaluated using a custom designed apparatus containing a Starrett MTH-550 manual force tester stand equipped with a Starrett DFC-20 digital force gauge. The digital force gauge was equipped with a gold-plated copper probe with a hemispherical tip 2.5 mm in diameter. The electrical resistance of the contact between the gold-plated probe and the flat coupon plated with the silver alloy of interest was measured using a 4-wire resistance measurement as the contact force was varied. The current source was a Keithley 6220 DC Current Source and the voltmeter was a Keithley 2182A Nanovoltmeter. These instruments were operated in thermoelectric compensation mode for maximum accuracy.

Tests were performed using flat, brass coupons electroplated with about 3 μm of binary silver-bismuth alloy from the aqueous acid binary silver-bismuth alloy electroplating bath disclosed in Example 1 above. Applied force is measured using Starrett DGF-20 Digital Force Gauge and is adjusted using a manual height stage. The contact resistance is in Table 1 below.

TABLE 1

| Contact Resistance | |
|---|---|
| Force (cN) | Ag (98%)—Bi(2%)/Brass (mΩ) |
| 0 | 800 |
| 5 | 225 |
| 10 | 120 |
| 20 | 90 |
| 30 | 80 |
| 40 | 70 |
| 50 | 60 |
| 60 | 50 |
| 70 | 40 |
| 80 | 20 |
| 90 | 10 |
| 100 | 10 |

Example 10 (Comparative)

Silver Wear Resistance

Tribological measurements were performed using an Anton Paar TRB3 Pin-on-Disk tribometer equipped with a linear reciprocating stage (available from Anton Paar GmbH, Graz, Austria). All tests were performed using 1 N loading, a stroke length of 10 mm, and a sliding speed of 5 mm/s. All tests were performed "like-on-like", meaning that the flat coupon and the spherical ball were each plated with the same silver metal deposit produced from a SILVER GLO™ electrolytic silver bath available from DuPont de Nemours. The ball used was made of C260 brass (70% copper, 30% zinc) and was 5.55 mm in diameter and was electroplated with about 5 μm of silver. The flat coupon was also made of C260 brass and electroplated with about 5 μm of silver. During the test, coefficient of friction was monitored using the tribometer. Wear track depth was measured using laser profilometry. The measurements were done for 100 cycles where each cycle was one back and forth stroke of the ball on the coupon. 100 cycles were all that was required to break through the silver plated deposit. The profilometry measurements were performed using a Keyence VK-X Laser Scanning Confocal Microscope (available from Keyence Corporation of America, Elmwood Park, N.J.). The wear tracks were measured using laser profilometry at a magnification of 200×. The 3D and 2D profilometry graphics were created from these measurements using VK-X Analysis software from Keyence.

Figure 2:
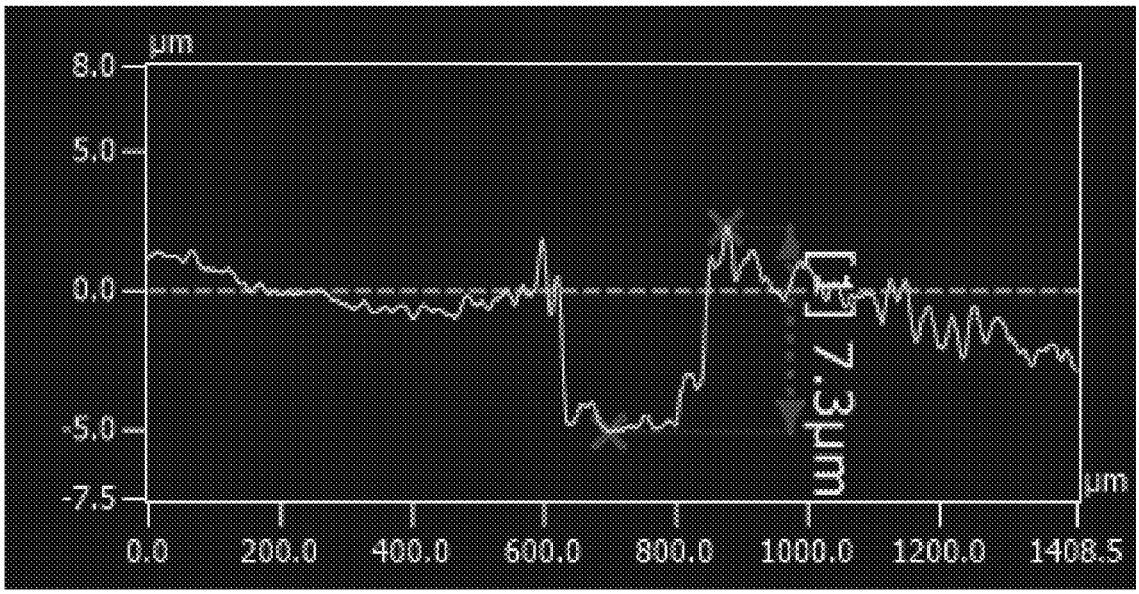
FIG. 2 is a 2D profilometry graphic of a surface of a silver metal deposit wherein the x-axis and y-axis are calibrated in microns (μm).
Figure 3:
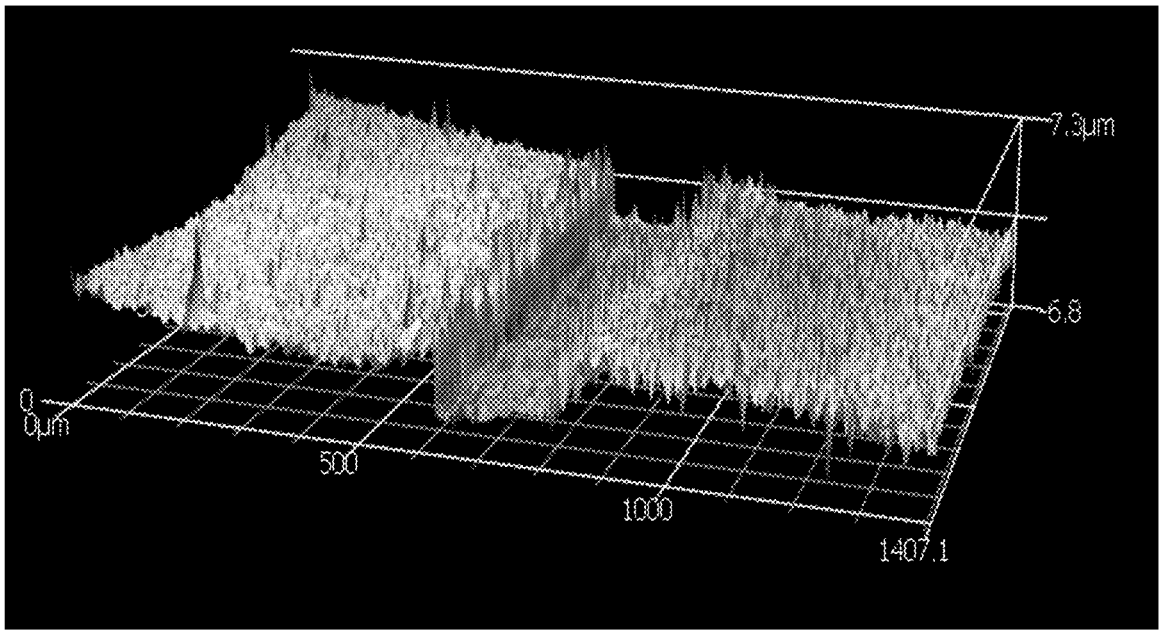
FIG. 3 is a 3D profilometry graphic of a surface of a silver metal deposit wherein the x-axis, y-axis and z-axis are calibrated in microns (μm).

FIG. 2 is the 2D profilometry graph of the silver deposit which shows major surface wear of the silver from 600 μm to 800 μm along the x-axis and from +2 μm to −5 μm along the y-axis. The vertical dotted line indicates the depth of the indent-wear track which is 7.3 μm. FIG. 3 is the 3D profilometry graph of the silver deposit which further exemplifies the serious surface wear of the silver deposit after 100 cycles. The scale shows the depth of the indent wear track as in FIG. 2.

The coefficient of friction (COF) was determined to be about 1.6. The COF was directly measured by the tribometer described above using the software Tribometer, version 8.1.5.

Example 11 (Invention)

Binary Silver-Bismuth Alloy Wear Resistance

Tribological measurements are performed using the Anton Paar TRB3 Pin-on-Disk tribometer equipped with a linear reciprocating stage as in Example 10 above. All tests were performed using 1 N loading, a stroke length of 10 mm, and a sliding speed of 5 mm/s. The flat coupon and the spherical ball are each plated with the silver-bismuth alloy of Example 1 above. The ball used is made of C260 brass (70% copper, 30% zinc) and is 5.55 mm in diameter and is electroplated with about 5 μm of the silver-bismuth alloy. The flat coupon is also made of C260 brass and electroplated with about 2 μm of the alloy. During the test, coefficient of friction is monitored using the tribometer. Wear track depth is measured using the laser profilometry as in Example 10 with the Keyence VK-X Laser Scanning Confocal Microscope. The measurements are done for 500 cycles. The wear tracks are measured using laser profilometry at a magnification of 200×. A 3D profilometry graphic is created from these measurements using the software from Keyence.

Figure 4:
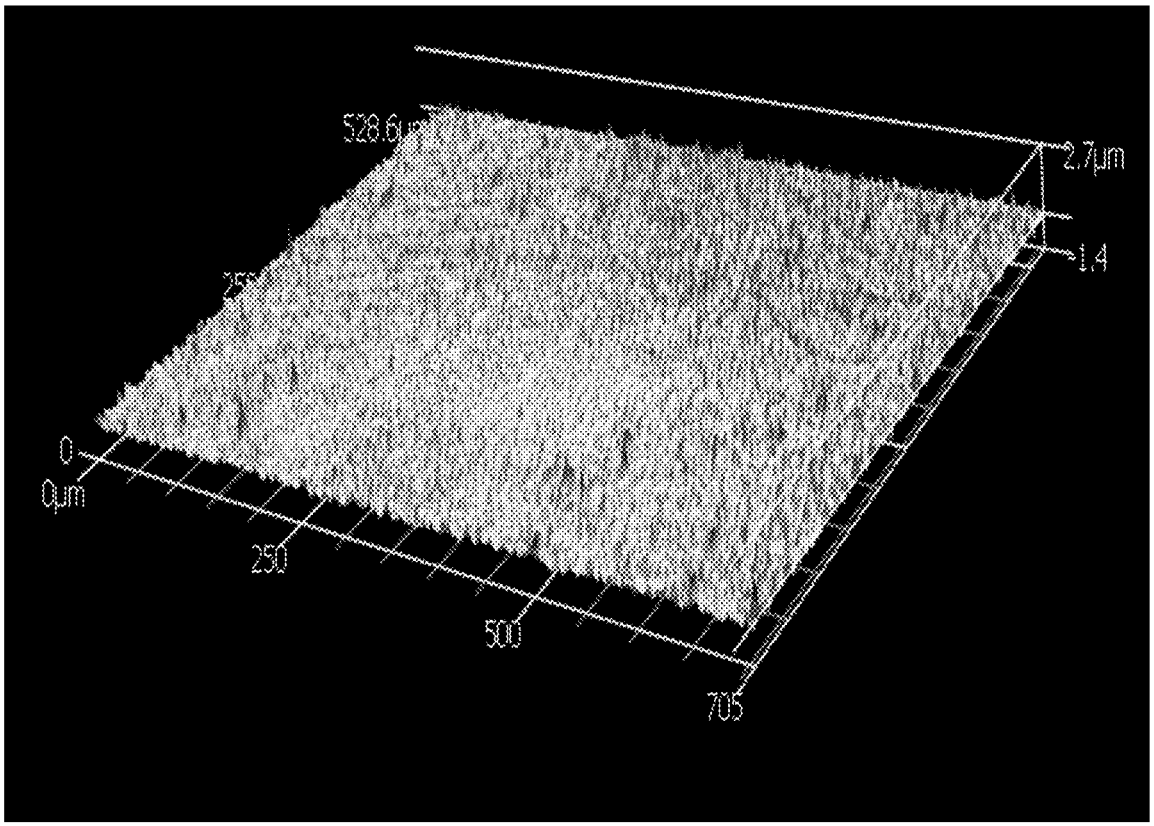
FIG. 4 is a 3D profilometry graphic of a surface of a silver-bismuth alloy deposit of the invention wherein the alloy is composed of 98% silver and 2% bismuth, and the x-axis, y-axis and z-axis are calibrated in microns (μm).

FIG. 4 is the 3D profilometry graph of the silver-bismuth deposit. There is no indication of surface wear even after 500 cycles. The coefficient of friction is determined to be about 0.3 which is an 80% reduction over the silver in Example 10.

What is claimed is:

1. A binary silver-bismuth alloy electroplating composition comprising a source of silver ions, a source of bismuth ions, and a thiol terminal aliphatic compound chosen from one or more of 2-mercaptopropionic acid, 3-mercaptopropionic acid, cysteine, mercaptosuccinic acid, 3-mercapto-1-propanesulfonic acid, 2-mercaptoethanesulfonic acid and salts of the thiol terminal compounds, and a pH of less than 7.

2. The binary silver-bismuth alloy electroplating composition of claim 1, further comprising one or more hydroxy bis-sulfide compounds.

3. The binary silver-bismuth alloy electroplating composition of claim 1, further comprising one or more acids or salts thereof.

4. The binary silver-bismuth alloy electroplating composition of claim 1, further comprising one or more pH adjusting agents.

5. The binary silver-bismuth alloy electroplating composition of claim 1, wherein the pH is from 0 to 6.

6. A method of electroplating a binary silver-bismuth alloy on a substrate comprising:

a) providing the substrate;

b) contacting the substrate with a binary silver-bismuth alloy electroplating composition comprising a source of silver ions, a source of bismuth ions, and a thiol terminal aliphatic compound 2-mercaptopropionic acid, 3-mercaptopropionic acid, cysteine, mercaptosuccinic acid, 3-mercapto-1-propanesulfonic acid, 2-mercaptoethanesulfonic acid and salts of the thiol terminal compounds, and a pH of less than 7; and c) applying an electric current to the binary silver-bismuth alloy electroplating composition and substrate to electroplate a binary silver-bismuth deposit on the substrate.

7. The method of claim 6, wherein the binary silver-bismuth alloy electroplating composition further comprises one or more dihydroxy bis-sulfide compounds.

8. The method of claim 6, wherein the binary silver-bismuth electroplating composition further comprises one or more acids and salts thereof.

9. The method of claim 6, wherein the binary silver-bismuth alloy electroplating composition further comprises one or more pH adjusting agents.

10. The method of claim 6, wherein the binary silver-bismuth alloy electroplating composition has a pH of 0 to 6.

* * * * *